US009308409B2

(12) United States Patent
Beaver et al.

(10) Patent No.: US 9,308,409 B2
(45) Date of Patent: Apr. 12, 2016

(54) FUNCTIONAL TRAINING RIG KIT

(71) Applicant: BEAVERFIT LIMITED, Church Stretton Shropshire (GB)

(72) Inventors: Tom Beaver, Church Stretton (GB); Jim Beaver, Church Stretton (GB)

(73) Assignee: Beaverfit Limited, Church Stretton Shropshire (GB)

( * ) Notice: Subject to any disclaimer, the term of this patent is extended or adjusted under 35 U.S.C. 154(b) by 0 days.

(21) Appl. No.: 14/388,496

(22) PCT Filed: Jul. 18, 2013

(86) PCT No.: PCT/EP2013/065173

§ 371 (c)(1),
(2) Date: Sep. 26, 2014

(87) PCT Pub. No.: WO2014/013011

PCT Pub. Date: Jan. 23, 2014

(65) Prior Publication Data

US 2015/0014212 A1 Jan. 15, 2015

(30) Foreign Application Priority Data

Jul. 19, 2012 (GB) ..... 1212830.2

(51) Int. Cl.
*A63B 17/04* (2006.01)
*A63B 23/04* (2006.01)
(Continued)

(52) U.S. Cl.
CPC . *A63B 17/04* (2013.01); *A63B 1/00* (2013.01); *A63B 21/00047* (2013.01);
(Continued)

(58) Field of Classification Search
CPC .... A63B 17/04; A63B 1/00; A63B 21/00047; A63B 21/068; A63B 70/0036; A63B 2071/025; A63B 2210/50; A63B 2225/09; A63B 23/03558; A63B 23/0458; A63B 23/1218
See application file for complete search history.

(56) References Cited

U.S. PATENT DOCUMENTS 2,219,219 A 10/1940 Boger
2,632,645 A 3/1953 Barkschat
(Continued)

FOREIGN PATENT DOCUMENTS

DE 20110717 U1 9/2001
EP 0384702 A1 8/1990
GB 648641 A 1/1951

OTHER PUBLICATIONS https://www.youtube.com/watch?v=MsDAULtypz4, Jul. 2, 2012 [Accessed Dec. 3, 2014] 1 page.
(Continued)

*Primary Examiner* — Loan H Thanh
*Assistant Examiner* — Sundhara Ganesan
(74) *Attorney, Agent, or Firm* — Fay Sharpe LLP

(57) ABSTRACT

A functional training rig kit includes a box and a plurality of components adapted to fit within the box. The components include at least two posts adapted to extend in an upright direction from the box, the posts, each having a length greater than the longest dimension of the box, include at least two elongate members dimensioned to fit within the box and adapted to be removably fastened together to form one of the posts. A bar is adapted to extend transversely between adjacent posts, the bar being dimensioned to fit within the box. At least one angled support member is provided for each of the posts. Each support member is adapted to fit within the box and is configured so that, at least when the functional training kit is assembled, the support member is secured to one of the posts and supports the post relative to a ground surface.

21 Claims, 20 Drawing Sheets

(51) Int. Cl.

| | |
|---|---|
| ***A63B 23/035*** | (2006.01) |
| ***A63B 71/00*** | (2006.01) |
| ***A63B 1/00*** | (2006.01) |
| ***A63B 21/068*** | (2006.01) |
| ***A63B 23/12*** | (2006.01) |
| ***A63B 21/00*** | (2006.01) |
| ***A63B 71/02*** | (2006.01) |

(52) U.S. Cl.
CPC ..... *A63B 21/068* (2013.01); *A63B 23/03558* (2013.01); *A63B 23/0458* (2013.01); *A63B 23/1218* (2013.01); *A63B 71/0036* (2013.01); *A63B 2071/025* (2013.01); *A63B 2210/50* (2013.01); *A63B 2225/09* (2013.01)

(56) References Cited

U.S. PATENT DOCUMENTS

| | | | | |
|---|---|---|---|---|
| 2,682,402 | A | 6/1954 | McCarthy | |
| 3,664,666 | A | 5/1972 | Lloyd | |
| 3,874,657 | A * | 4/1975 | Niebojewski | 482/104 |
| 4,300,761 | A | 11/1981 | Howard | |
| 4,431,181 | A | 2/1984 | Baswell | |
| 4,921,245 | A * | 5/1990 | Roberts | 482/42 |
| 4,927,135 | A * | 5/1990 | Nieppola | 482/41 |
| 4,976,428 | A | 12/1990 | Ghazi | |
| 4,976,623 | A | 12/1990 | Owsley | |
| 5,013,035 | A | 5/1991 | Nathaniel | |
| 5,242,345 | A | 9/1993 | Mitchell | |
| 5,405,306 | A * | 4/1995 | Goldsmith et al. | 482/120 |
| 5,449,336 | A | 9/1995 | Sabel | |
| 5,466,204 | A | 11/1995 | Nearing | |
| 5,542,897 | A | 8/1996 | Hall | |
| 5,575,742 | A | 11/1996 | Wu | |
| 5,667,461 | A | 9/1997 | Hall | |
| 5,966,956 | A | 10/1999 | Morris et al. | |
| 6,027,429 | A | 2/2000 | Daniels | |
| 6,090,021 | A | 7/2000 | Flowers et al. | |
| 6,245,001 | B1 | 6/2001 | Siaperas | |
| 6,273,846 | B1 | 8/2001 | Savage et al. | |
| 6,280,361 | B1 | 8/2001 | Harvey et al. | |
| 6,350,221 | B1 | 2/2002 | Krull | |
| 6,422,981 | B1 | 7/2002 | Riser | |
| 6,454,683 | B1 | 9/2002 | Kaye | |
| 6,520,890 | B2 | 2/2003 | Hsu | |
| 6,554,747 | B1 | 4/2003 | Rempe | |
| 6,558,301 | B1 | 5/2003 | Jackson | |
| 6,612,845 | B1 | 9/2003 | Macri et al. | |
| 6,634,998 | B2 | 10/2003 | Siaperas | |
| 7,311,642 | B2 | 12/2007 | Li et al. | |
| 7,520,840 | B2 | 4/2009 | Shifferaw | |
| 7,614,988 | B1 * | 11/2009 | Kiser | 482/142 |
| 2002/0078861 | A1 | 6/2002 | David | |
| 2003/0146212 | A1 | 8/2003 | Mai et al. | |
| 2003/0213188 | A1 | 11/2003 | Bigelow | |
| 2004/0237870 | A1 | 12/2004 | Clarke et al. | |
| 2005/0032612 | A1 | 2/2005 | Keiser | |
| 2005/0032613 | A1 | 2/2005 | Wehrell | |
| 2006/0052220 | A1 | 3/2006 | Jackson et al. | |
| 2006/0199706 | A1 | 9/2006 | Wehrell | |
| 2006/0293156 | A1 | 12/2006 | Trees | |
| 2007/0032357 | A1 * | 2/2007 | Piane, Jr. | 482/142 |
| 2007/0113487 | A1 | 5/2007 | Warminsky | |
| 2007/0117503 | A1 | 5/2007 | Warminsky | |
| 2007/0232461 | A1 | 10/2007 | Jenkins et al. | |
| 2009/0023566 | A1 * | 1/2009 | Florczak | 482/142 |
| 2009/0072111 | A1 * | 3/2009 | Piane, Jr. | 248/309.1 |
| 2009/0098987 | A1 * | 4/2009 | McBride et al. | 482/133 |
| 2009/0124464 | A1 | 5/2009 | Kastelic | |
| 2009/0143160 | A1 | 6/2009 | Hoganson | |
| 2009/0176588 | A1 * | 7/2009 | Lochtefeld | 472/128 |
| 2009/0215594 | A1 * | 8/2009 | Panaiotov | 482/130 |
| 2009/0282749 | A1 | 11/2009 | Warminsky | |
| 2010/0124996 | A1 * | 5/2010 | Lindsay | 472/94 |
| 2010/0300906 | A1 * | 12/2010 | Moore | 206/315.1 |
| 2011/0152046 | A1 * | 6/2011 | Rochford | 482/131 |
| 2011/0195822 | A1 * | 8/2011 | Donofrio | 482/93 |
| 2011/0319230 | A1 * | 12/2011 | Brendle | 482/37 |
| 2012/0077429 | A1 | 3/2012 | Wernimont et al. | |
| 2012/0142506 | A1 * | 6/2012 | Hetrick et al. | 482/142 |
| 2012/0144762 | A1 | 6/2012 | Eatock et al. | |

OTHER PUBLICATIONS https://crossfitpenrith.blogspot.co.uk/2009/08/rest-day.html#comment-form, Aug. 2, 2009 [Accessed Dec. 3, 2014] 1 page.

International Search Report of International Application No. PCT/EP2013/065173 dated Oct. 8, 2013, 3 pages.

* cited by examiner

FUNCTIONAL TRAINING RIG KIT

This invention relates to a kit for a functional training rig.

Functional training rigs are frameworks that allow a user to perform a range of functional training exercises, developing body strength using traditional bodyweight exercises, as well as providing a structure to support accessories such as jumping platforms, grapplers, bungee hooks, dip bars and J-pegs which facilitate integration with other gym equipment. To this end a functional training rig generally comprises a plurality of upright components each supporting a cantilever, with horizontal bars interconnecting the cantilevers. A problem with such functional training rigs is that, once assembled, they are permanent structures which occupy a significant space and are therefore not suited to use in areas which can only be assigned temporarily to fitness training for an individual or group.

There are many situations where an individual or group may wish to undertake exercise in an area which cannot be permanently dedicated to fitness training alone. Nevertheless, such areas are used for training, even though they cannot be properly set up for training purposes, because of the need for an individual or group to undertake exercise either as part of an essential professional capacity or as part of a personal fitness goal based on keeping fit and healthy. Such fitness training may be undertaken, for example, in the home (such as a garden, garage or spare room), a health, athletics or sports club (where areas are required for multiple purposes), military environments (such as parade grounds, helicopter decks and the like), hotel and convention meeting rooms, village halls, offices, rural fields, village greens, military bases, parks, and sports fields. Unfortunately, in these areas training is often limited in the range of exercise movements possible or training is performed in a hazardous manner due to the use of inadequate temporary structures.

It would be desirable to be able to provide a functional training rig which can readily be assembled and dismantled and can be conveniently stored, while being safe to use.

It is therefore an object of the present invention to provide a functional training rig which overcomes, or at least ameliorates, the above-mentioned problem.

According to the present invention there is provided a functional training rig kit comprising a box and a plurality of components adapted to fit within the box, the components including: at least two posts adapted to extend in an upright direction from the box, the posts each having a length greater than the longest dimension of the box and comprising at least two elongate members dimensioned to fit within the box and adapted to be removably fastened together to form one of the posts; a bar adapted to extend transversely between adjacent posts, the bar being dimensioned to fit within the box; and at least one angled support member for each of the posts, each support member being adapted to fit within the box and provided with means for securing the support member to one of the posts and with means to engage a ground surface The box may be provided with at least one further angled support member for each of the posts, each further support member being adapted to fit within the box and provided with means for securing the further support member to one of the posts and with means to engage a part of the box. One or more of the further support members may be provided with a foot, for example of L-shaped cross section, adapted to be secured to an elongate edge of the box, for example opposite to the edge at which the posts are secured.

The box may be provided with a lid, such as a hinged lid or a removable lid.

The box may be provided internally thereof with a plurality of supports for receiving the components adapted to fit within the box.

The box may be provided at opposite ends thereof with handles and/or with apertured members for receiving lifting means such as one or more of the elongate members.

The elongate members forming one of the posts may be interconnected end-to-end by means of a sleeve, such as an external sleeve and/or an internal sleeve. The or each sleeve may be secured to at least one, ideally both, of the elongate members.

The box may be provided with recesses, for example formed in corners of the box at opposite ends of one elongate side thereof, for receiving each of the posts. The recesses may extend substantially from a base of the box to an upper edge thereof. The recesses may be provided with an internal dowel for engaging within a respective post. Alternatively, one of the elongate members forming each of the posts may be hinged to the box.

The elongate members may be provided with through holes at intervals for receiving accessories for the functional training rig. Adjacent through holes may be arranged at right angles to each other.

One or more of the support members may be provided with a lateral ground-engaging foot.

The bar may be adapted to be mounted at each end thereof on a cantilever assembly adapted to fit within the box. Each cantilever assembly may comprise one or two angled arms mounted on a plate adapted to be secured to the post. Alternatively, each cantilever assembly may comprise a triangular plate mounted on the plate adapted to be secured to the post. A sleeve may be used instead of a plate, the sleeve ideally being closed at an end thereof to limit travel relative to the post. The sleeve may be provided with an internal dowel which engages within the top of the post.

The box may be provided with wheels.

For a better understanding of the present invention and to show more clearly how it may be carried into effect reference will now be made, by way of example, to the accompanying drawings in which.

Figure 1:
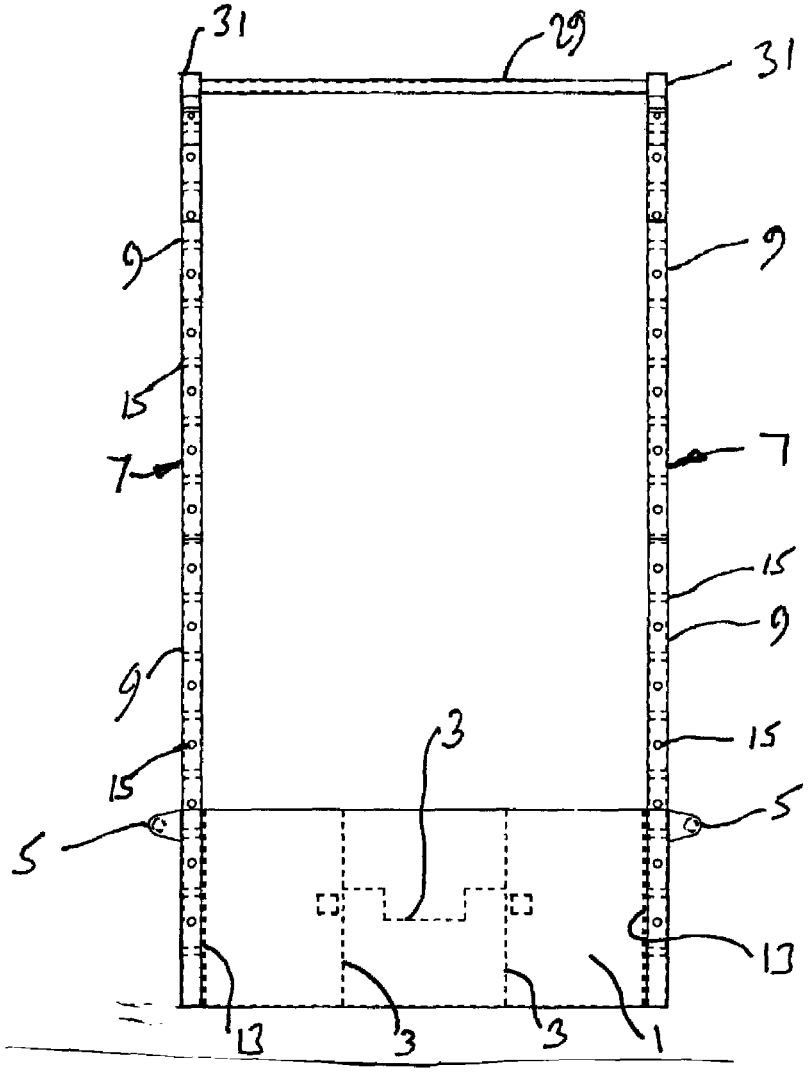
FIG. 1 is a front view of one embodiment of a functional training rig assembled from a functional training rig kit according to the present invention.
Figure 2:
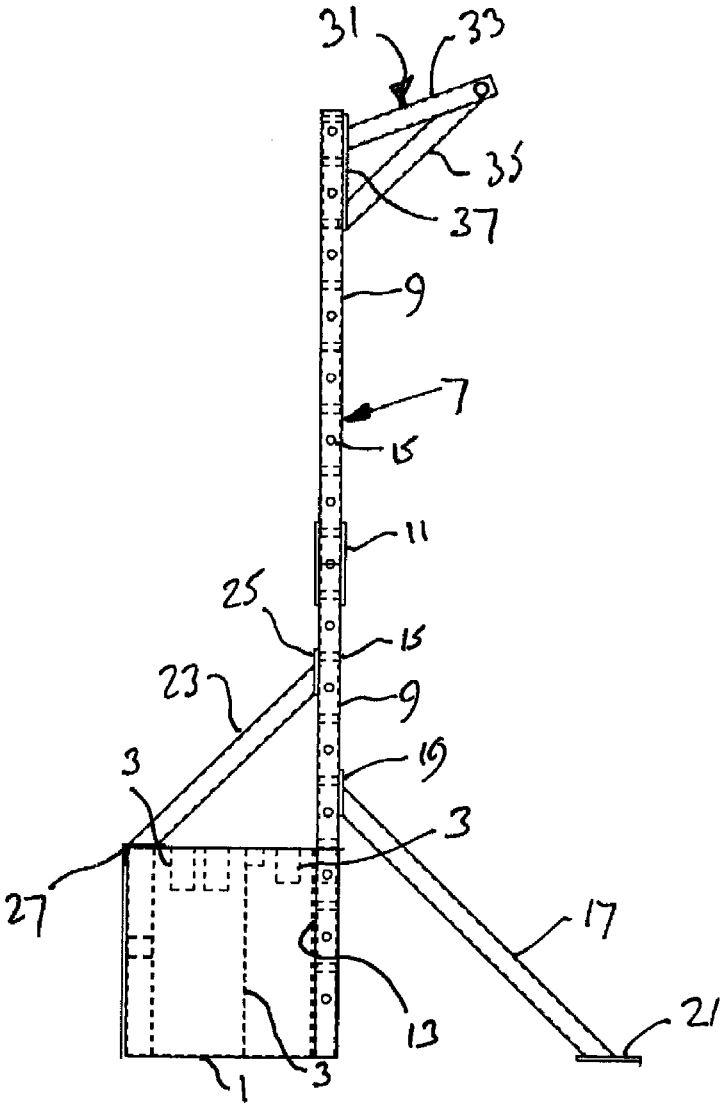
FIG. 2 is a side view of the functional training rig shown in FIG. 1.
Figure 3:
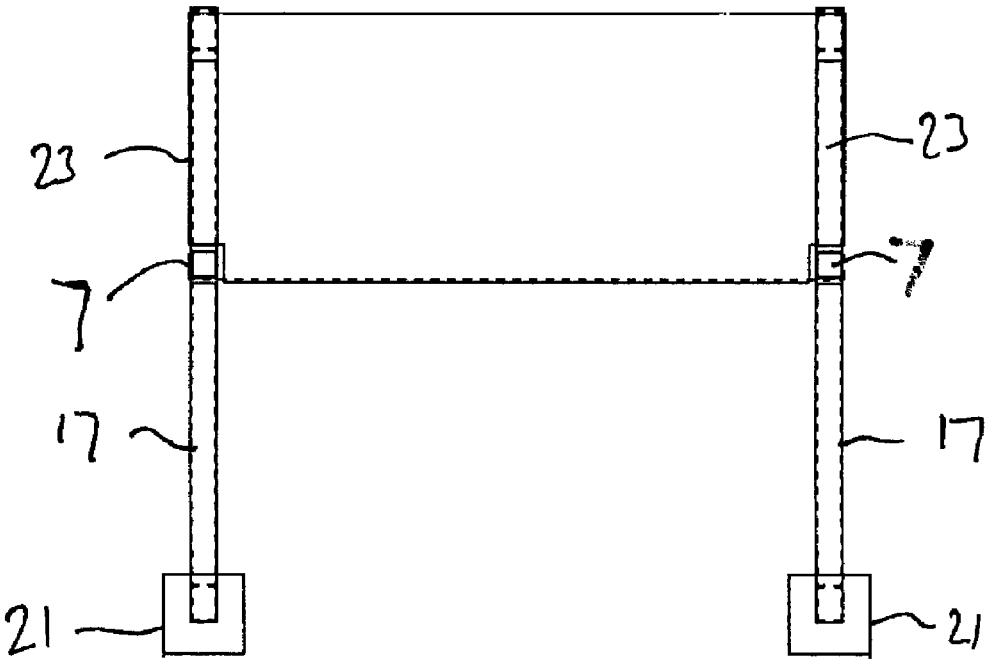
FIG. 3 is a plan view of the functional training rig shown in FIG. 1.
Figure 4:
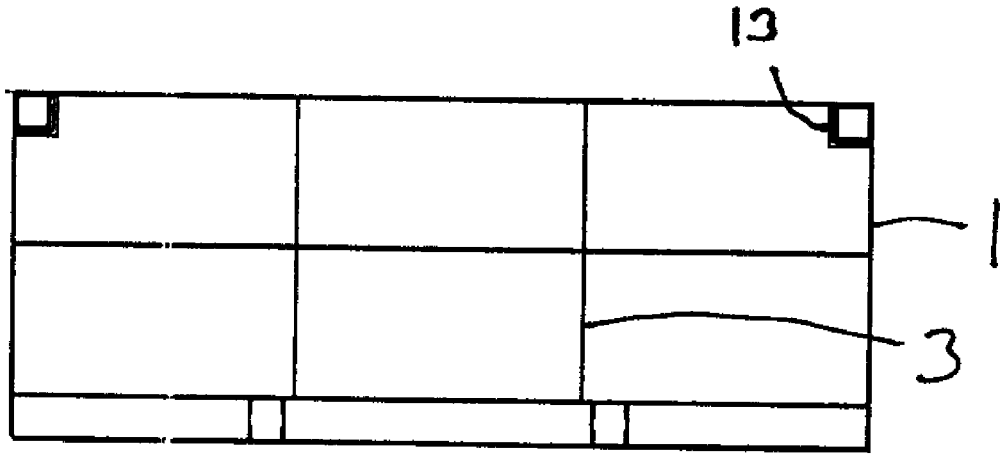
FIG. 4 is a plan view of a box forming part of the functional training rig kit shown in FIG. 1.

The functional training rig and functional training rig kit shown in FIGS. 1 to 4 comprises a box 1 which may or may not be provided with a lid, such as a hinged lid or a removable lid. The box is made of a suitable material, such as steel or aluminium, and is dimensioned to fit into many normal vehicles, having a width, for example, of about 1200 mm and a depth and height of about 500 mm. Provided within the box 1 is a plurality of supports 3 which are designed to receive frame components of the functional training rig. The supports 3 are secured within the box 1, for example by welding. The box is provided with handles 5 at each end thereof.

The frame components of the functional training rig may also be made of steel or aluminium and are ideally primarily of square hollow section. The frame components will be described in more detail hereinafter.

The frame components and the box 1 combine to form a functional training rig kit which can readily be assembled and dismantled, with frame components being stored within the box when not in use and the box 1 forming part of, and contributing to the stability of, the rig when assembled.

The frame components include two upright posts 7 which are formed by a plurality (two as shown in FIGS. 1 to 4) of elongate members 9 which are interconnected end-to-end by means of an external sleeve 11 or other means of interconnecting the elongate members (such as an internal connector) which is secured to each of the elongate members. The elongate members 9 are dimensioned to fit within the box 1, whereas the upright posts, at nearly 2400 mm, are too long to fit within the box. The resulting posts 7 are inserted into complementary recesses 13 formed in corners of the box at opposite ends of one elongate side thereof, the recesses ideally extending substantially from the base of the box to the upper edge thereof. Alternatively, one of the elongate members 9 forming each of the posts 7 may be hinged to the box 1. Thus, the box 1 contributes to the stability of the upright posts 7. The elongate members 9, and therefore the posts 7, may be provided with through holes 15 at intervals for receiving accessories for the functional training rig to facilitate particular exercises. Adjacent through holes 15 may be arranged at right angles to each other, as illustrated, although other arrangements are also possible. As a further alternative, the through holes may be omitted.

Each upright post is further stabilised by means of two angled support members which extend in opposing directions from the posts at a downward angle so as to engage with the ground and/or with the box 1. The support members are dimensioned to fit within the box when not in use. As illustrated, one of the support members engages with the box 1 at its lower end, but alternatively the support member may engage with the ground. Thus, in FIGS. 1 to 4 a support member 17 extends at a downward angle from each of the upright posts 7 to contact the ground. At its upper end, the support member 17 is provided with an upright plate 19 which enables the support member to be removably secured to the upright post 7, for example by means of threaded fasteners, and at its lower end the support member is provided with a lateral ground-engaging foot 21. In addition, a support member 23 for each of the upright posts 7 is provided at its upper end with an upright plate 25 which enables the support member to be removably secured to the upright post 7, for example by threaded fasteners, and at its lower end the support member is provided with a foot 27, for example of L-shaped cross section, which is removably secured to an elongate edge of the box 1 opposite to the edge at which the upright posts 7 are secured. The foot 27 is therefore able to engage both an upper surface and a side surface of the box 1, although other arrangements are possible. The foot 27 may be secured to the box 1 by means of suitable fasteners, such as threaded fasteners. Alternatively, the support member 23 may extend to the ground and may be provided with a lateral ground-engaging foot in a similar manner to support member 17.

The upper ends of the upright posts 7 are removably secured together by means of a lateral bar 29, for example of circular cross-section, which is mounted at each end thereof on a cantilever assembly 31. The lateral bar and the cantilever assemblies are dimensioned to fit within the box when not in use. As illustrated in FIGS. 1 to 4, each cantilever assembly 31 comprises two angled arms 33, 35 which are mounted on an upright plate 37 which is removably secured to the upright posts 7, for example by way of threaded fasteners. As can be seen from FIG. 2, one of the arms 33, 35 is longer than the other arm so as to form a triangular assembly with the free ends of the arms 33, 35 secured together at lateral bar 29. In the illustrated arrangement the lateral bar is at a higher level than the top of the posts 7, but other arrangements are possible. It should be noted the cantilever assembly can take other forms, such as a triangular plate replacing the two arms 33, 35.

Figure 5:
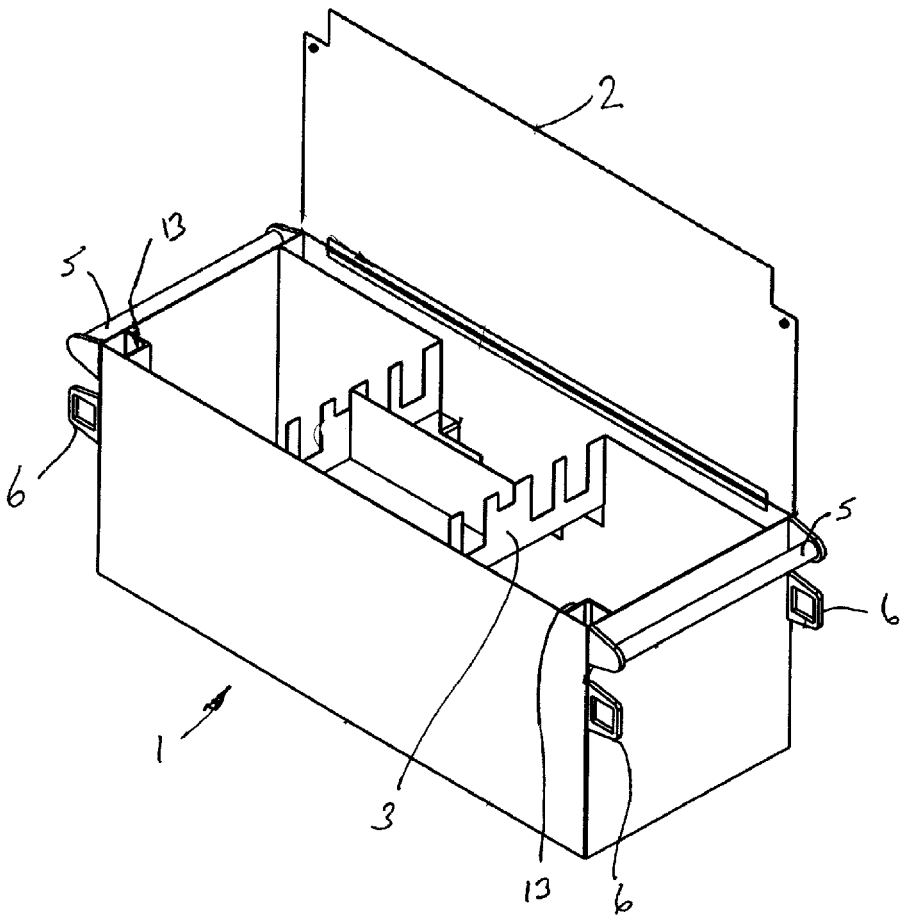
FIG. 5 is a perspective view of a modified box forming part of the functional training rig.
Figure 6:
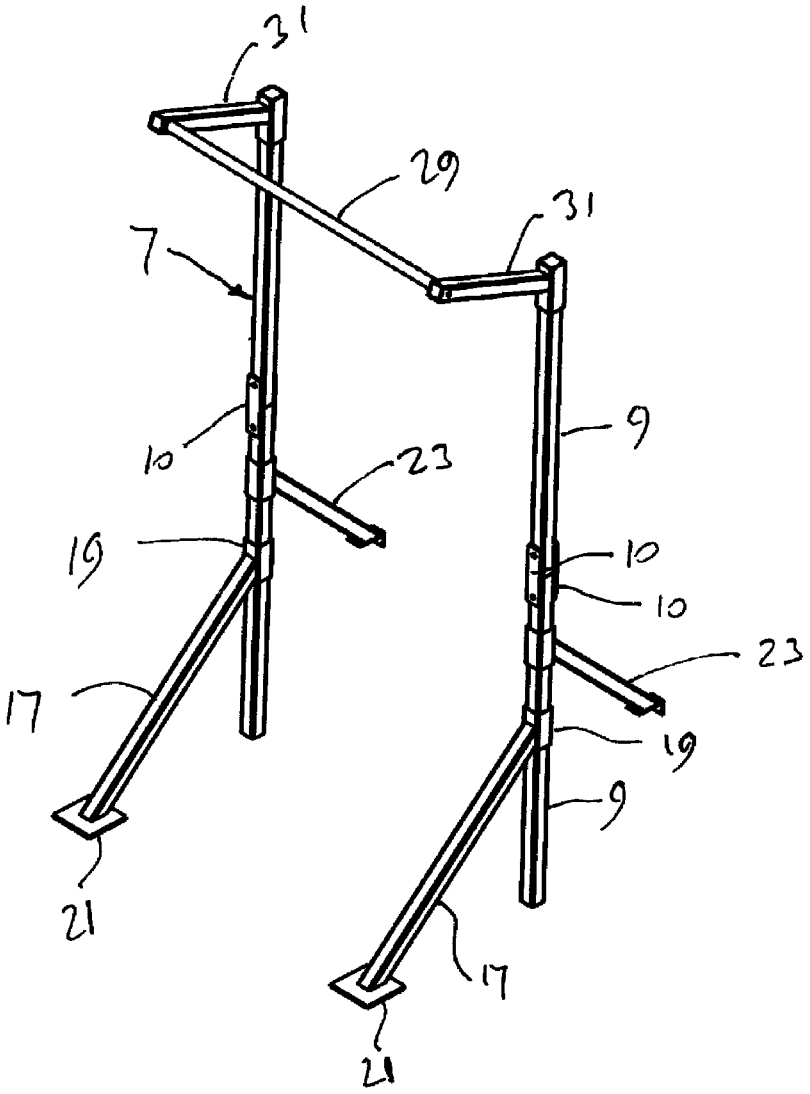
FIG. 6 is a perspective view of another embodiment of a functional training rig assembled from a functional training rig kit according to the present invention.
Figure 7:
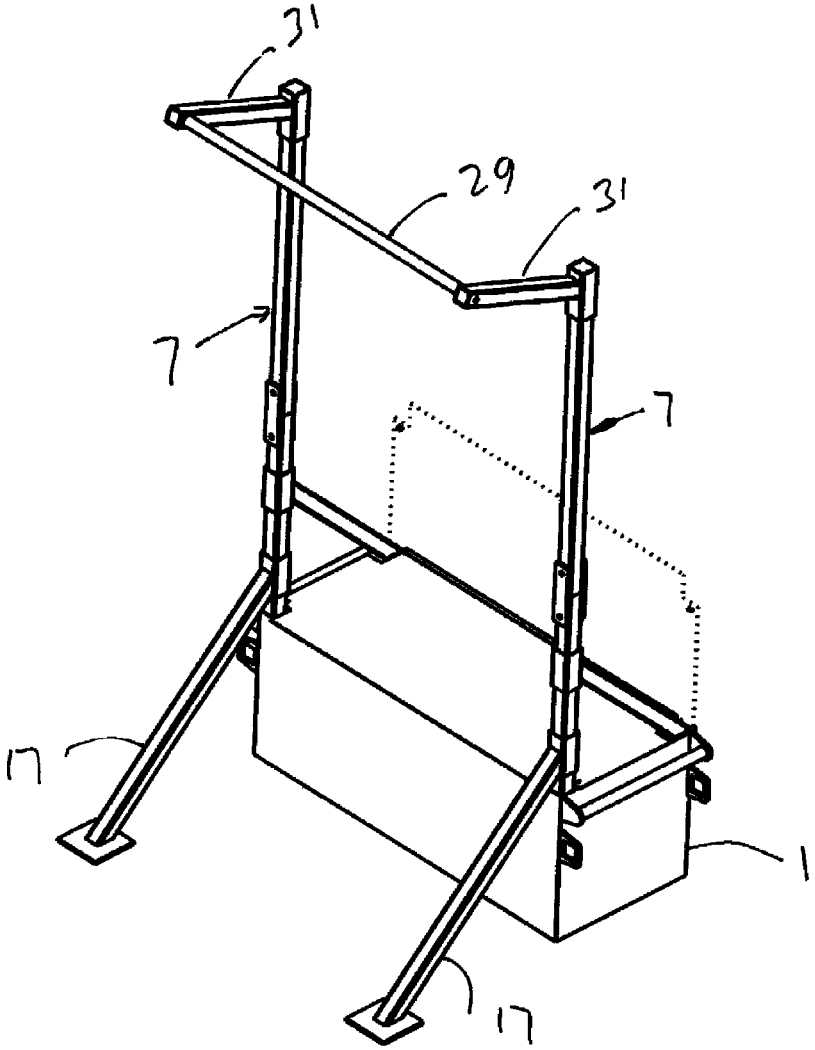
FIG. 7 is a perspective view of the functional training rig of FIG. 6 without the box.

The functional training rig and functional training rig kit shown in FIGS. 5 to 7 is a modification of that shown in FIGS. 1 to 4 and the same references are used to denote the same or similar features. Features from this second embodiment may be exchanged with features from the first embodiment and vice versa. The box 1 is provided with a hinged lid 2 which is formed with cutouts in the free corners to accommodate the upright posts 7 and with supports 3 to receive frame components of the functional training rig. The box 1 is provided with handles 5 at each end thereof and with an apertured member 6 secured externally to corners of the box, for example at a level beneath the handles 5. The apertured members 6 are dimensioned to receive the elongate members 9 to allow a number of people, for example four, to lift the box by way of the elongate members.

The elongate members 9 forming the upright posts 7 are interconnected end-to-end by means of an internal sleeve (not shown) in combination with external plates 10 which are secured to opposing faces of the elongate members bridging the joint between adjoining elongate members, for example by threaded fastenings. In contrast to the embodiment of FIGS. 1 to 4, the elongate members 9 are not provided with through holes for receiving accessories.

The support members 17 and 23 are formed with sleeves 19 rather than with upright plates for securing to the upright posts 7.

The lateral bar 29 is mounted at each end thereof on a cantilever assembly 31. The cantilever assembly comprises an angled arm attached to a sleeve which engages over the top of the upright post 7, the upper end of the sleeve being closed to limit travel relative to the upright post.

Figure 10:
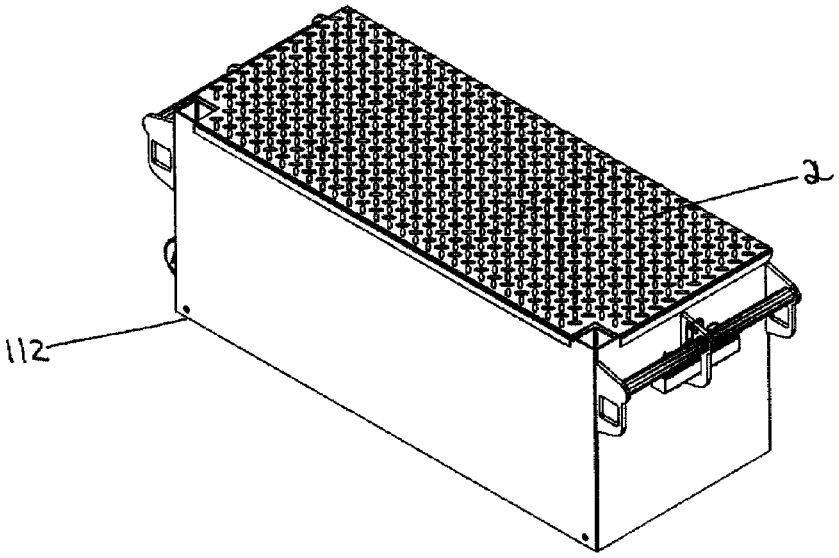
FIG. 10 is a perspective view of a closed box forming part of the rig of FIG. 8.
Figure 11:
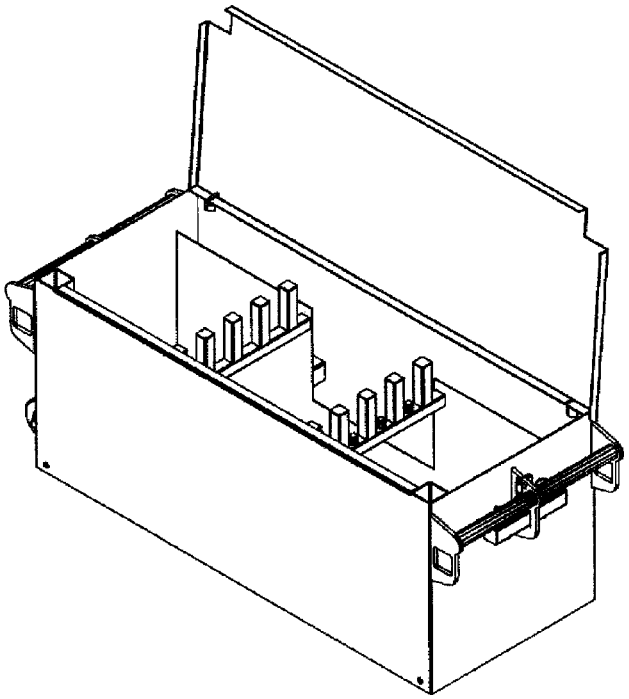
FIG. 11 is a perspective view of the box of FIG. 10 with an open lid.
Figure 12:
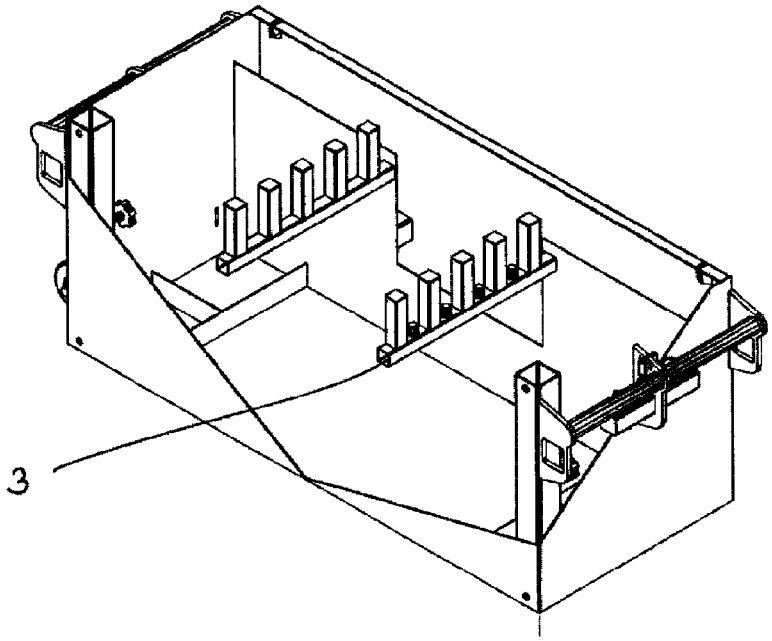
FIG. 12 is a partly cut-away view of the box shown in FIGS. 10 and 11.
Figure 13:
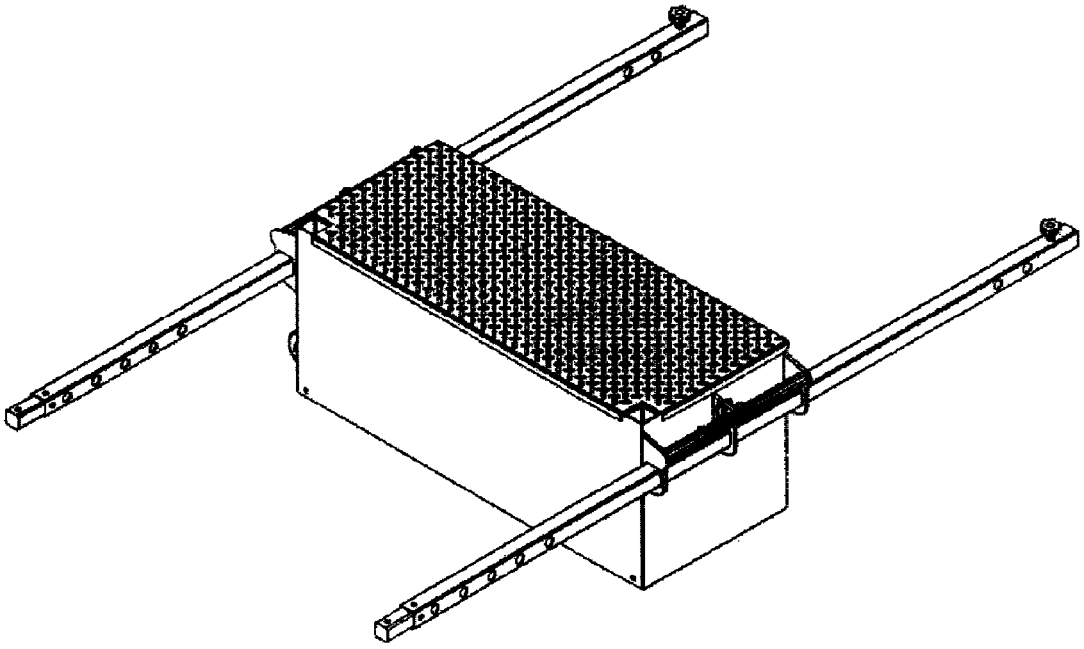
FIG. 13 is a perspective view of the box of FIGS. 10 to 12 adapted for carrying.
Figure 14:
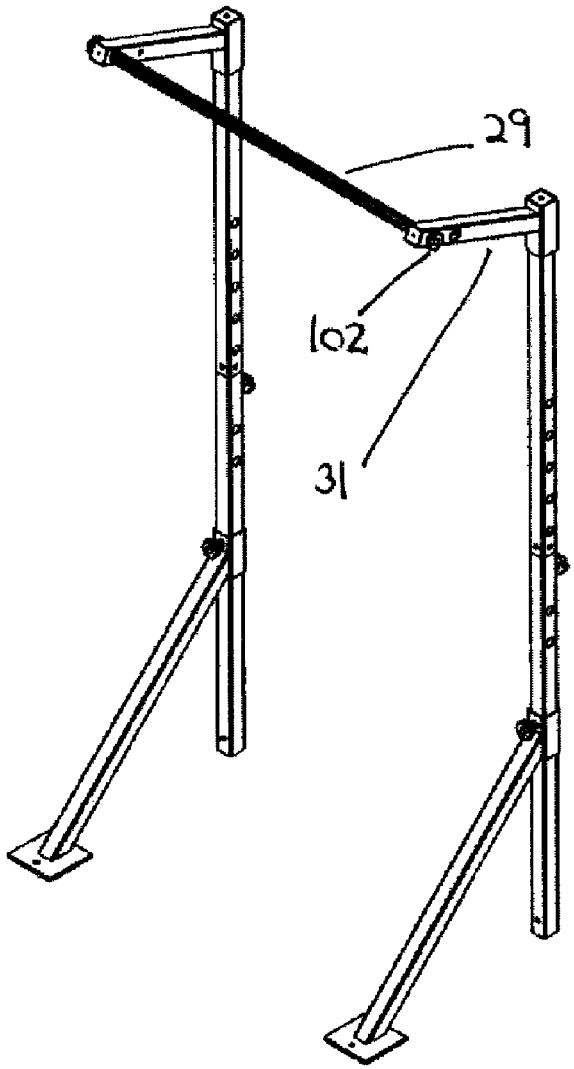
FIG. 14 is a perspective view of a frame forming part of the rig of FIG. 8.
Figure 18:
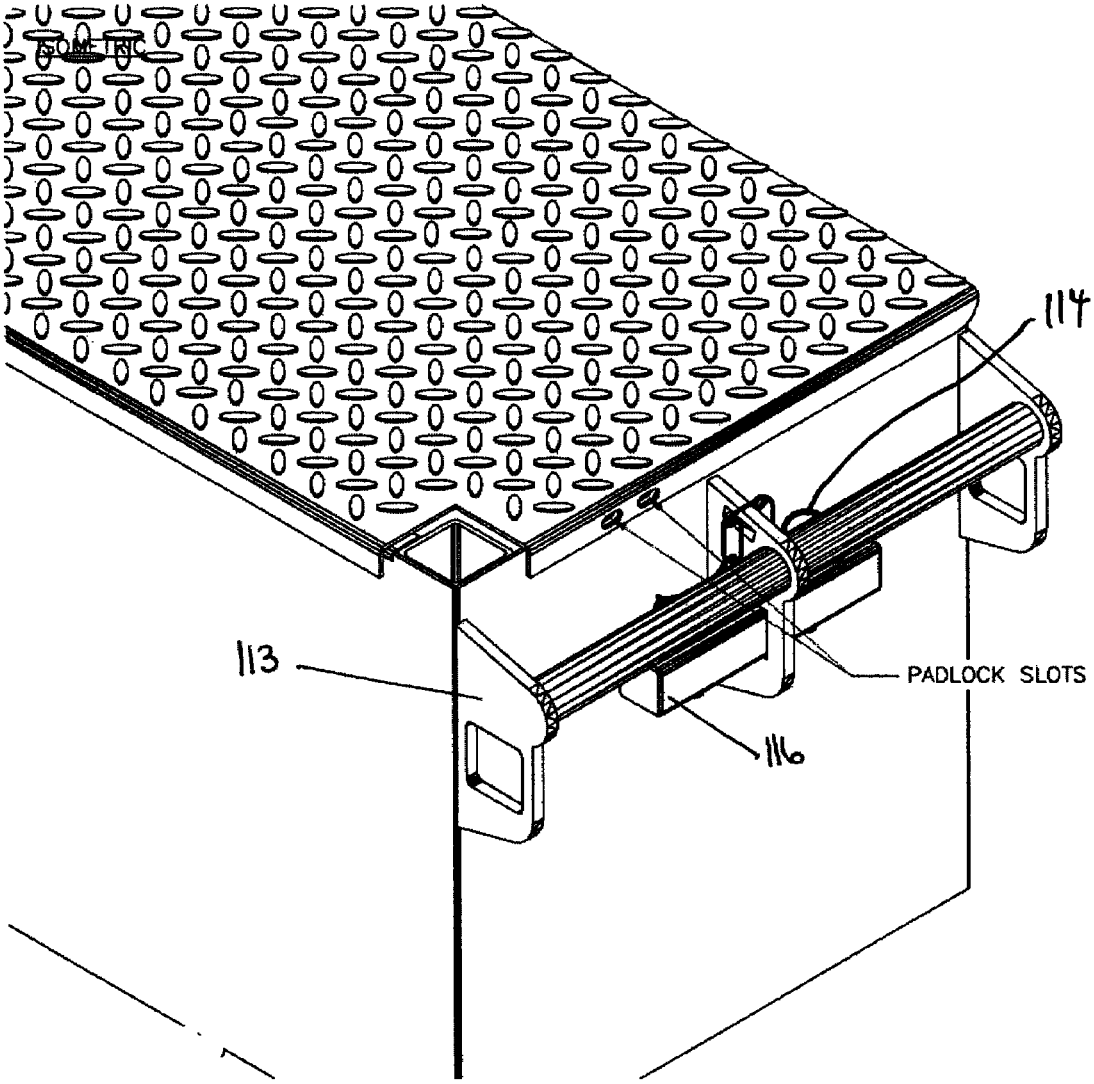
FIG. 18 is a perspective view of part of the box on a larger scale.

The functional training rig shown in FIGS. 8 to 20 is similar to those shown in FIGS. 1 to 4 and 5 and the same references are used to denote the same or similar parts. The functional training rig of FIG. 8 differs in a number of respects. For example, the support member 23 is omitted. A plate 113 supports the ends of the handle 5 is combined with aperture member 6 to strengthen the aperture member. An additional handle-supporting plate is positioned substantially mid-way along the handle 5 and bearer lugs 116 and locking pins 114 are provided on the additional handle-supporting plate for receiving and securing the elongate members 9 as shown in FIG. 13. Thus, to improve safety, the elongate members 9 are locked in place when the rig is being carried. The lid 2 is no longer a substantially planar plate, but now is formed with a lip which extends around the three sides of the lid other than the side at which it is hinged. This assists in minimising water penetration into the box. As shown in FIG. 18, two slotted holes may be formed in the lip, for example along one of the sides of the box, and corresponding holes may be formed in the wall of the box to accept a (long shank) padlock or other securing device. This provides security for the items stored in the box when the rig is being transported or is in storage and, when the rig is in use, prevents the lid being opened so improving safety, especially where the holes are at a side of the box as illustrated. Further, the outer surface of the lid may be profiled (such as Durbar plate) to provide a more secure footing during use. In addition, water drainage holes 112 (FIG. 10) are provided in the region of the bottom corners of the rear of the box to allow for water drainage and/or ventilation.

Wheels 103 have been added to one end of the box 1 to facilitate moving of the rig without the need for it to be carried.

Figure 19:
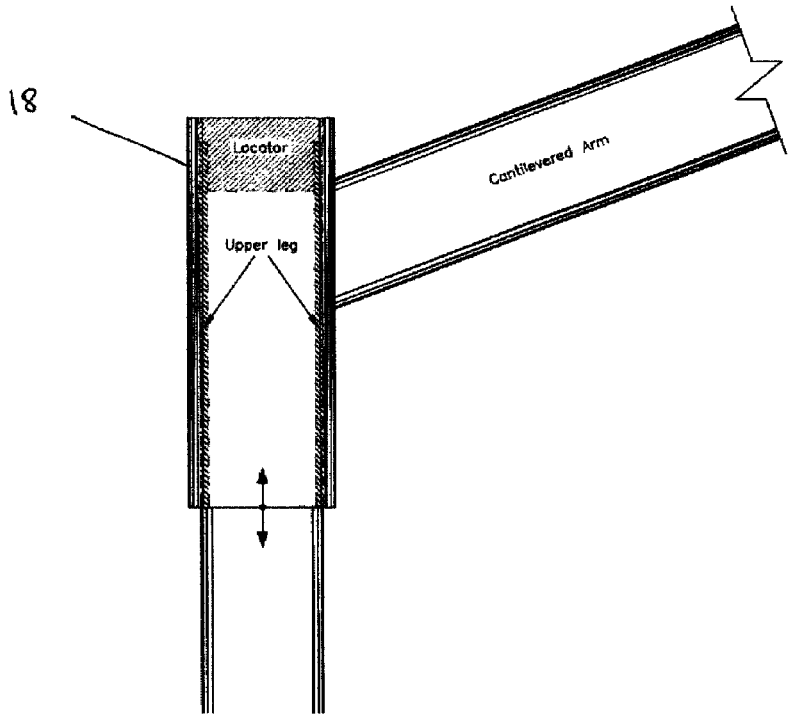
FIG. 19 is a side view of part of a frame forming part of the rig, on a larger scale.

As shown in particular in FIG. 19 the cantilever assembly 31 is mounted on the upright post 7 by way of an external sleeve which is closed at one end. In addition to this arrangement, which is the same as that shown and described in relation to FIGS. 1 to 7, the external sleeve is also provided with a locator in the form of an internal dowel which engages within the top of the upright post 7 to improve the stability of the rig. Although not shown in the drawings, a corresponding internal dowel may be provided at the base of the recesses 13 for receiving and locating the lower end of the upright post 7.

The various components may be numbered where they interconnect in order to facilitate assembly of the rig (for example by following instructions referring to the numbers). This applies in particular to the elongate members 9, support member 17 and cantilever assembly 31.

Figure 15:
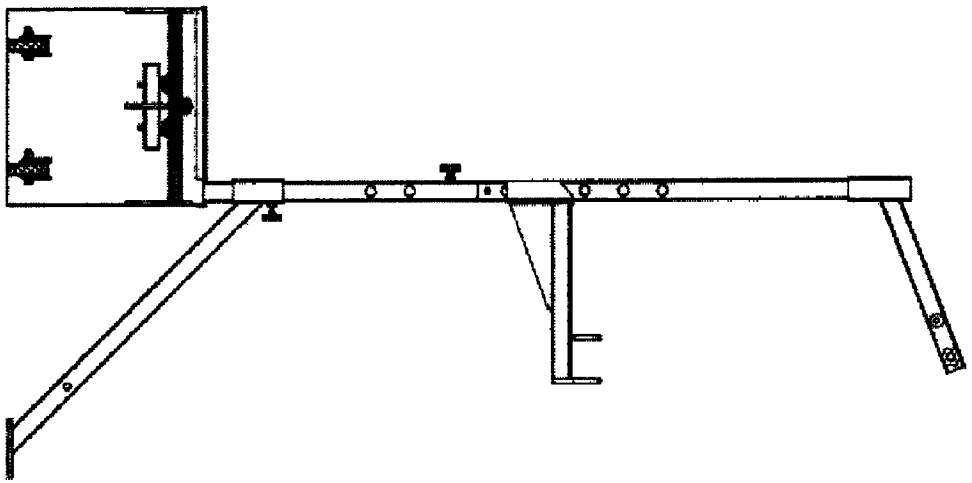
FIG. 15 is a view from one side of the rig of FIG. 8.
Figure 16:
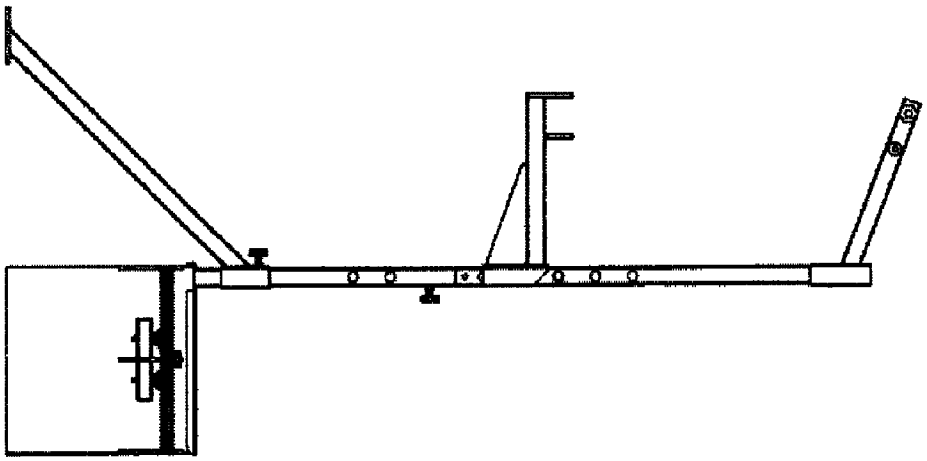
FIG. 16 is a view from the other side of the rig of FIG. 8.
Figure 17:
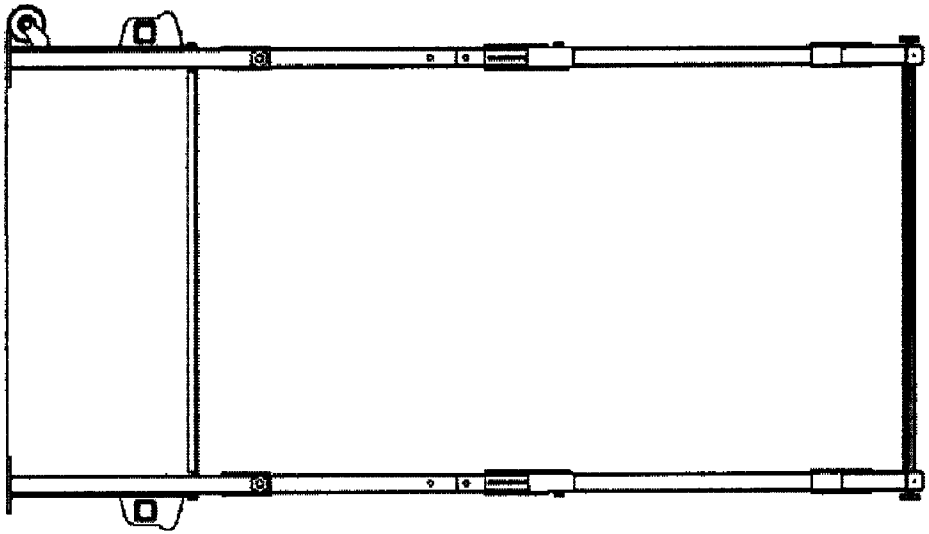
FIG. 17 is a front view of the rig of FIG. 8.
Figure 20:
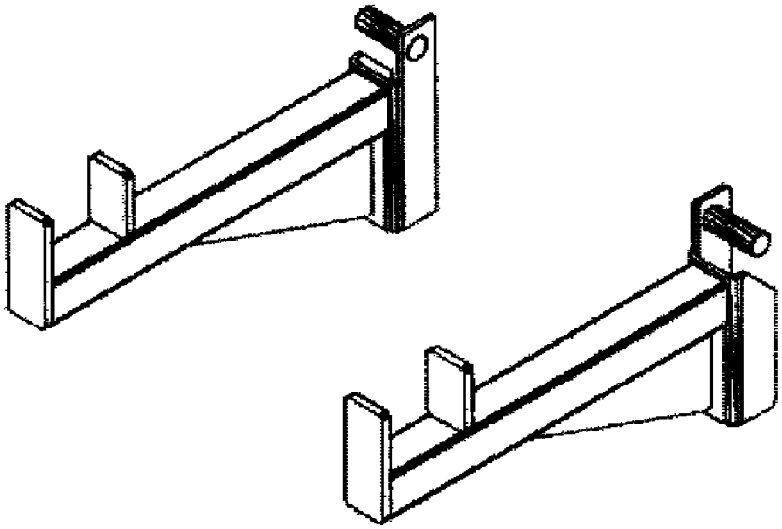
FIG. 20 shows an accessory for use with the rig of FIG. 8.

FIGS. 15 and 20 show an accessory 117 to be mounted to the upright posts 7 to increase the range of exercises that can be performed. As illustrated, the accessory is in the form of a safety squat arm to support weights. As shown the safety squat arms are left- and right-handed to minimise the risk of disengagement from the upright posts 7 when in use. The accessories, where provided, are dimensioned to fit within the box when the rig is not in use.

Figure 8:
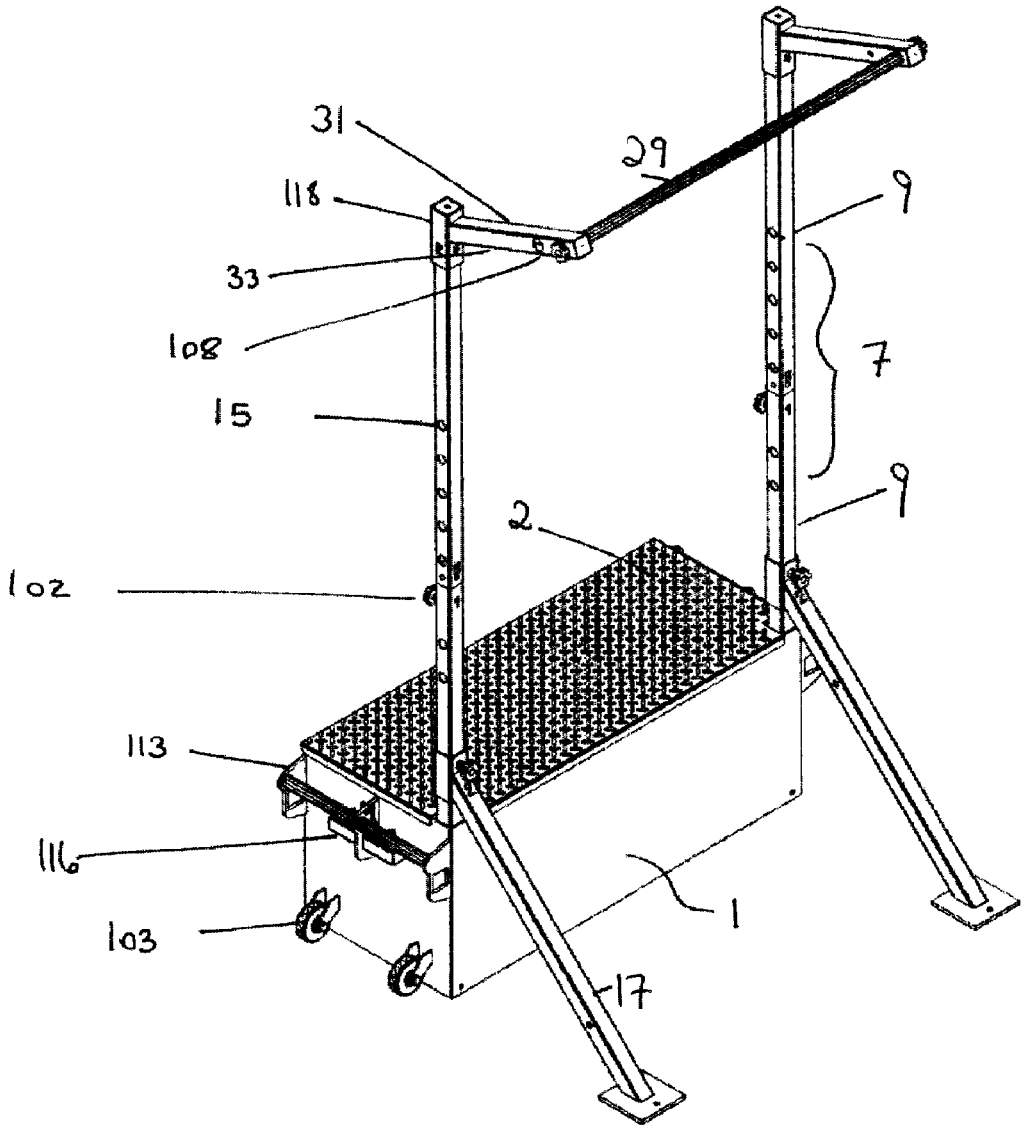
FIG. 8 is a modification of the functional training rig shown in FIGS. 1 to 4.
Figure 9:
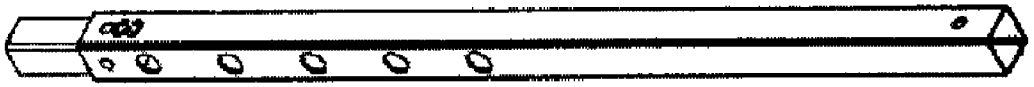
FIG. 9 is a perspective view of an upper elongate member forming part of the rig of FIG. 8.

FIGS. 21 to 25 show arrangements involving more than one of the rigs shown in FIG. 8.

Figure 21:
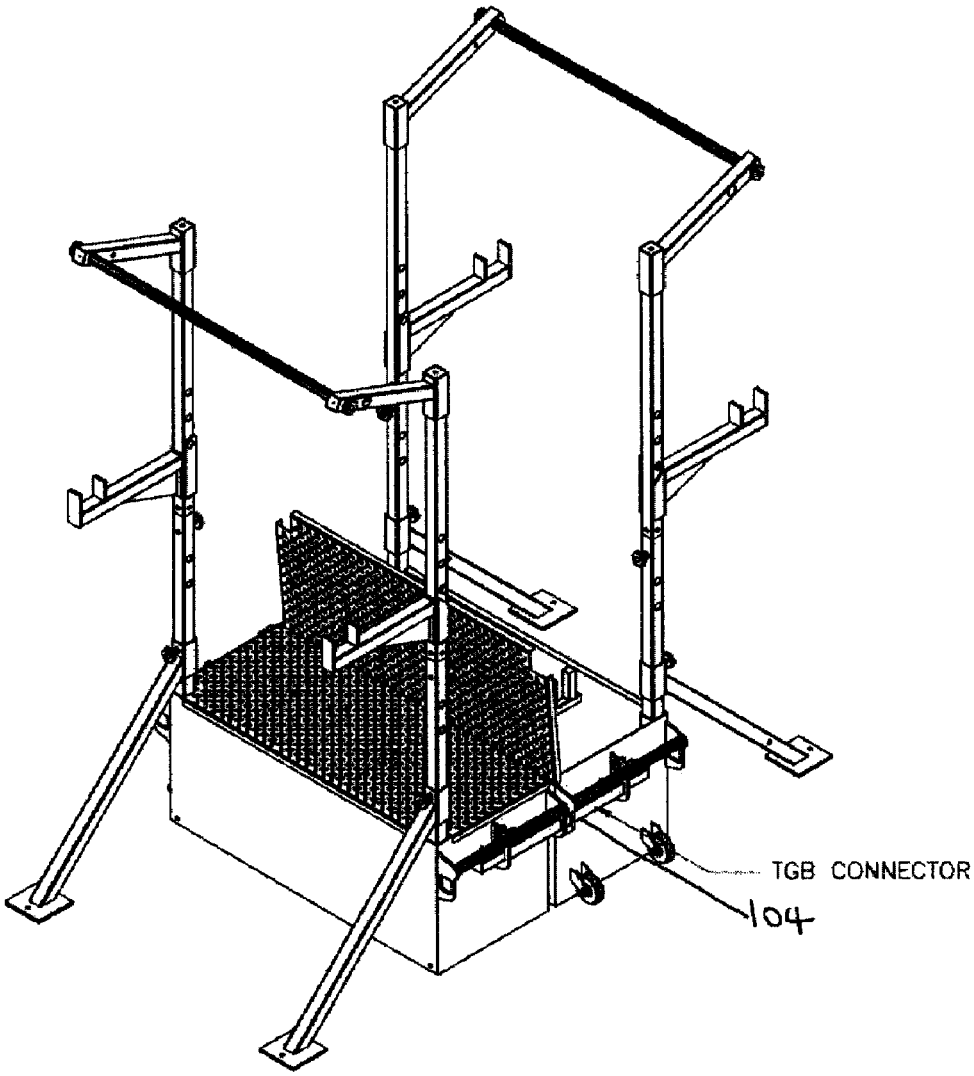
FIGS. 21 to 25 show arrangements involving more than one of the rigs shown in FIG. 8.

FIG. 21 shows two rigs positioned back to back with the cantilever assemblies both extending outwardly. An external sleeve 104 slides through the adjacent handle plates 113 at each end of each of the two boxes and over the respective bearer lug 116 shown in FIG. 8 of each of the boxes, with the locking pins 114 (see FIG. 18) securing the external sleeve to each of the boxes by way of openings provided in the end regions of the external sleeve. In this way the two boxes are secured together at each end and the two rigs are secured together. The external sleeves are dimensioned to fit within the boxes when not in use.

Figure 22:
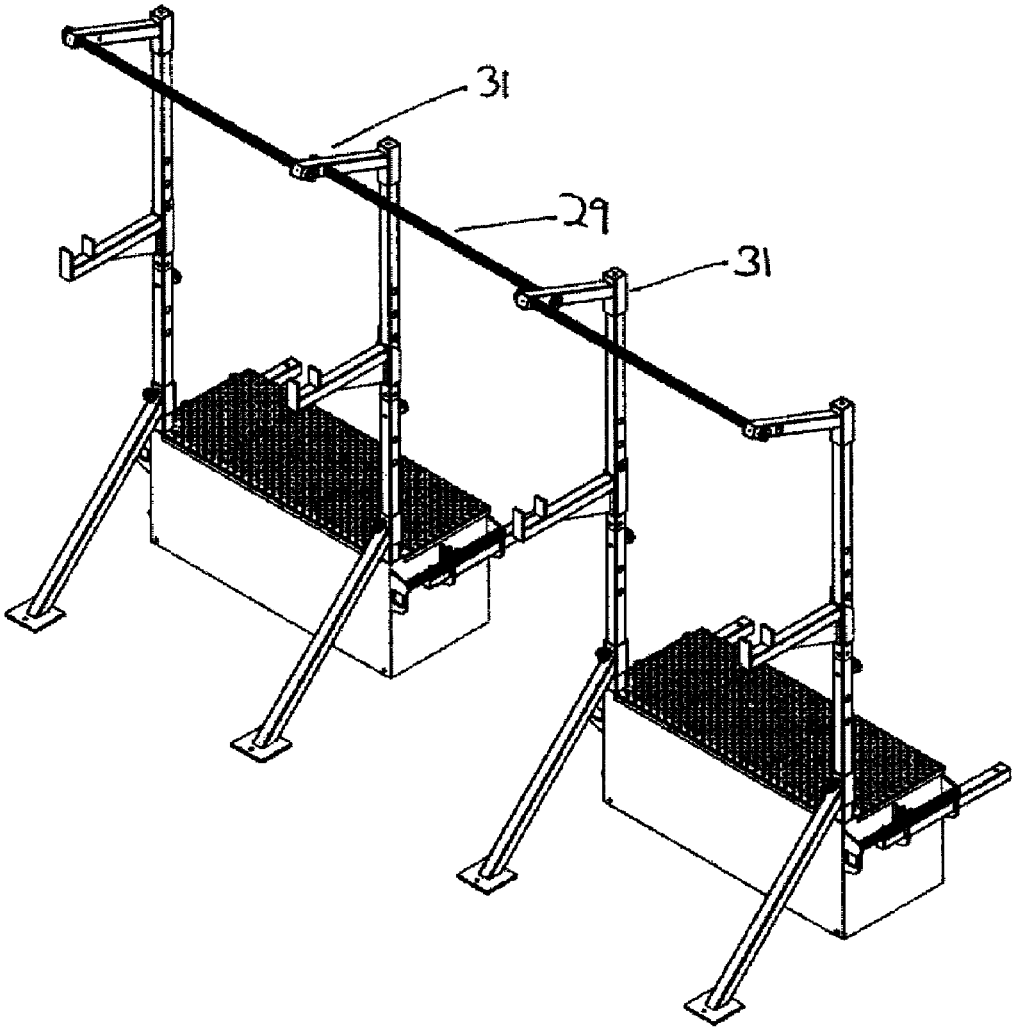

As shown in FIG. 22, two (or more) rigs may be placed in an end-to-end series with spaces between adjacent boxes. The boxes may face in the same direction or they may face in different directions. Adjacent boxes are joined together by means of a lateral bar 29 secured to the cantilever assembly 31. As shown, the lateral bar may be secured to the cantilever assembly by way of a hand wheel provided with a threaded member. It will be noted that FIG. 8 shows a hole 108 through the cantilever assembly 31 for mounting the additional lateral bar 29. The additional lateral bar may be dimensioned to fit within the boxes.

Figure 23:
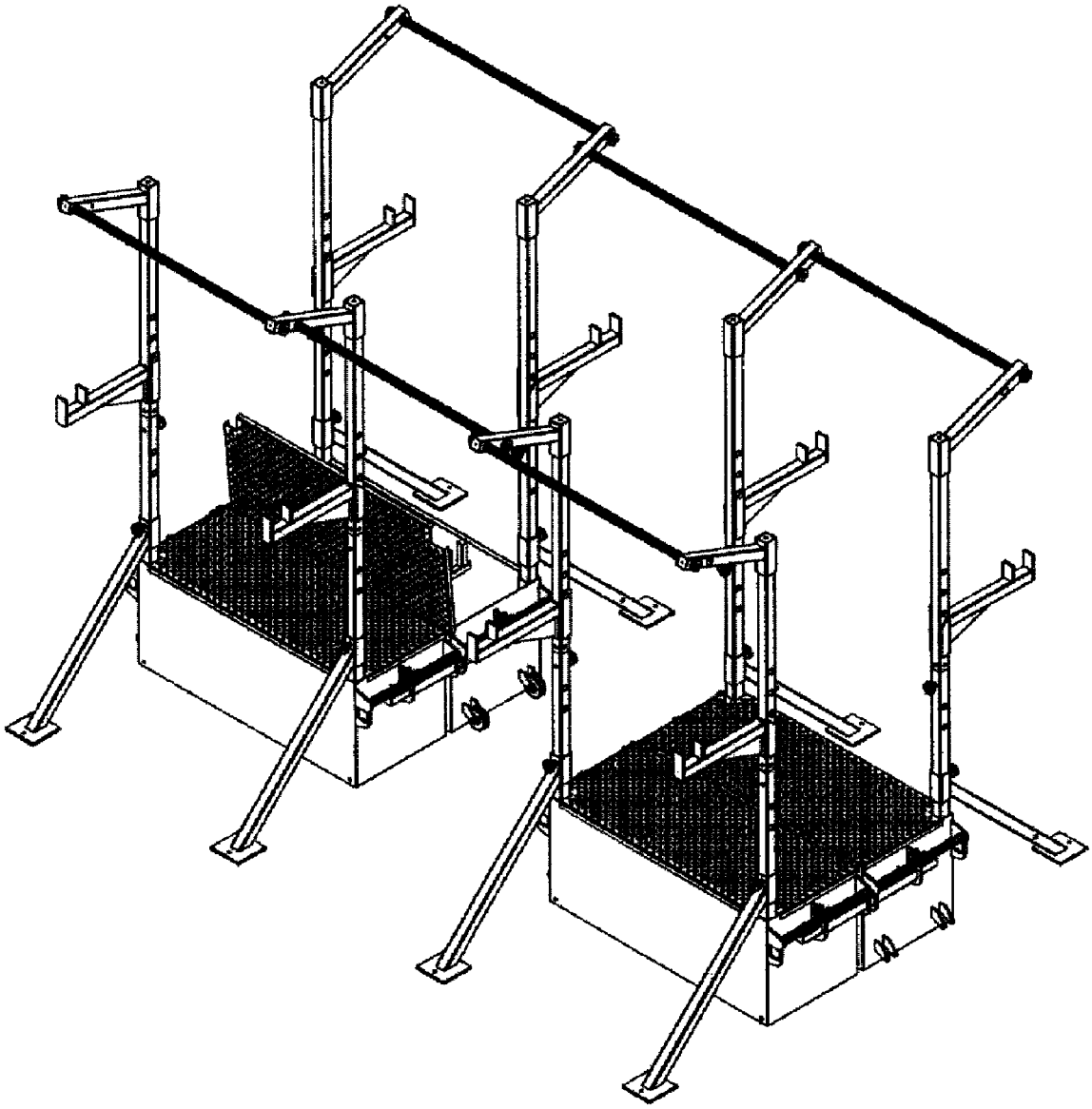

FIG. 23 shows a combination of back-to-back and end-to-end boxes.

Figure 24:
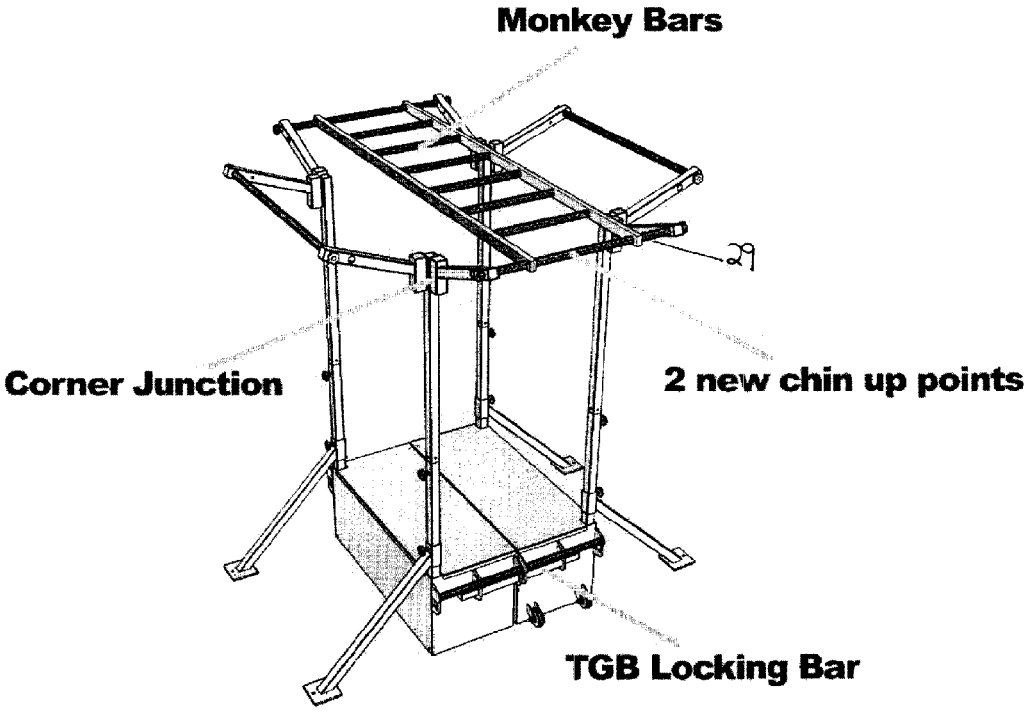

FIG. 24 shows two back-to-back boxes with a set of monkey bars secured to the tops of the four upright posts 7. The monkey bars may be mounted by way of a cantilever assembly to lengthen the monkey bars and to provide a chip-up point at each end.

Figure 25:
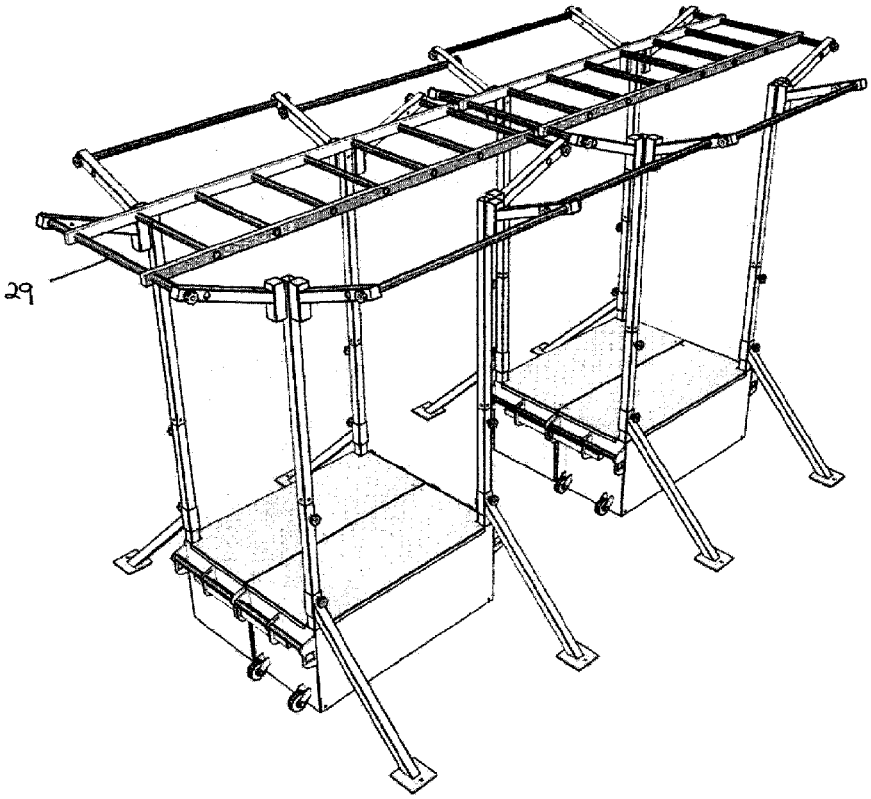

FIG. 25 corresponds to FIG. 23 but with the addition of a monkey bar assembly as shown in FIG. 24.

The invention claimed is:

1. A functional training rig kit comprising a box and a plurality of components adapted to fit within the box, the components including: at least two posts adapted to be connected to the box and to extend in an upright direction, the posts each having a length greater than the longest dimension of the box and comprising at least two elongate members dimensioned to fit within the box and adapted to be removably fastened together to form one of the posts; a bar adapted to extend transversely between adjacent posts, the bar being dimensioned to fit within the box; and at least one angled support member for each of the posts, each support member being adapted to fit within the box and configured so that, at least when the functional training kit is assembled, the support member is secured to one of the posts and supports the post relative to a ground surface, wherein the functional training rig is provided with at least one further support member for each of the posts, each further support member being adapted to fit within the box and being securable or secured to one of the posts and engageable with a part of the box.

2. A kit as claimed in claim 1, wherein the elongate members forming one of the posts are interconnected end-to-end by a sleeve.

3. A kit as claimed in claim 2, wherein one or more of the further support members is provided with a foot adapted to be secured to an elongate edge of the box.

4. A kit as claimed in claim 3, wherein the foot is secured opposite to an edge at which the posts are secured.

5. A kit as claimed in claim 2, wherein the further support member is a further angled support member.

6. A kit as claimed in claim 1, wherein the box is provided with a lid.

7. A kit as claimed in claim 1, wherein the box is provided at opposite ends thereof with handles and/or with apertured members for receiving a lifting element.

8. A functional training rig kit as claimed in claim 7, wherein the lifting element is one of the elongate members.

9. A kit as claimed in claim 1, wherein the box is provided with recesses for receiving each of the posts.

10. A kit as claimed in claim 9, wherein the recesses are formed in corners of the box at opposite ends of one elongate side thereof.

11. A kit as claimed in claim 9, wherein the recesses extend substantially from a base of the box to an upper edge thereof.

12. A kit as claimed in claim 1, wherein one of the elongate members forming each of the posts is hinged to the box.

13. A kit as claimed in claim 1, wherein the elongate members are provided with through holes at intervals for receiving accessories for the functional training rig.

14. A kit as claimed in claim 1, wherein the bar is adapted to be mounted at each end thereof on a cantilever assembly adapted to fit within the box.

15. A kit as claimed in claim 14, wherein each cantilever assembly comprises one or two angled arms mounted on a plate adapted to be secured to the post.

16. A kit as claimed in claim 15, wherein each cantilever assembly comprises a triangular plate mounted on the plate adapted to be secured to the post.

17. A kit as claimed in claim 14, wherein each cantilever assembly comprises one or two angled arms mounted on a sleeve adapted to be secured to the post.

18. A kit as claimed in claim 1, wherein the box is provided with wheels.

19. A kit as claimed in claim 1, wherein the support member is securable to one of the posts and engageable with the ground surface.

20. A functional training rig comprising a box and a plurality of components adapted to fit within the box, the components including: at least two posts connected to the box and extending in an upright direction, the posts each having a length greater than the longest dimension of the box and comprising at least two elongate members dimensioned to fit within the box and removably fastened together to form one of the posts; a bar extending transversely between adjacent posts, the bar being dimensioned to fit within the box; and at least one angled support member for each of the posts, each support member being adapted to fit within the box and being secured to one of the posts to support the post relative to a ground surface, wherein the functional training rig is provided with at least one further support member for each of the posts, each further support member being adapted to fit within the box and being securable or secured to one of the posts and engageable with a part of the box.

21. A functional training rig kit comprising a box and a plurality of components adapted to fit within the box, the components including: at least two posts adapted to extend in an upright direction from the box, the posts each having a length greater than the longest dimension of the box and comprising at least two elongate members dimensioned to fit within the box and adapted to be removably fastened together to form one of the posts; a bar adapted to extend transversely between adjacent posts, the bar being dimensioned to fit within the box; and at least one angled support member, each support member being adapted to fit within the box and being engageable with a ground surface, wherein the functional training rig is provided with at least one further support member for each of the posts, each further support member being adapted to fit within the box and being securable or secured to one of the posts and engageable with a part of the box.

* * * * *